US007080413B1

(12) United States Patent
Schneider

(10) Patent No.: US 7,080,413 B1
(45) Date of Patent: Jul. 25, 2006

(54) COLLAR GUARD

(76) Inventor: Katherine Schneider, 1129 Central Ave., Feasterville, PA (US) 19053

( * ) Notice: Subject to any disclaimer, the term of this patent is extended or adjusted under 35 U.S.C. 154(b) by 0 days.

(21) Appl. No.: 11/083,235

(22) Filed: Mar. 17, 2005

(51) Int. Cl.
*A41D 27/16* (2006.01)

(52) U.S. Cl. ..... 2/60; 2/50

(58) Field of Classification Search ..... 2/50, 2/60, 52, 49.1–49.5, 48, 46, 51, 468, 131, 2/132, 134–136, 139, 140, 143, 244, 207; D2/860–862, 500
See application file for complete search history.

(56) References Cited

U.S. PATENT DOCUMENTS

| | | | | | |
|---|---|---|---|---|---|
| 1,556,468 | A | * | 10/1925 | Oscar | 2/50 |
| 2,544,487 | A | * | 3/1951 | Caluthis | 2/50 |
| 2,559,226 | A | * | 7/1951 | Richardson | 2/133 |
| 2,637,034 | A | | 5/1953 | Smith | |
| 2,882,529 | A | * | 4/1959 | Argo | 2/50 |
| 2,947,004 | A | * | 8/1960 | Pfile | 2/50 |
| 3,213,464 | A | * | 10/1965 | Lewis | 2/50 |
| 3,857,116 | A | * | 12/1974 | Meeker | 2/50 |
| 3,860,967 | A | | 1/1975 | Tedesco | |
| 3,945,048 | A | * | 3/1976 | Shearer | 2/48 |
| 4,008,494 | A | | 2/1977 | Hicks | |
| 4,651,347 | A | | 3/1987 | Brown | |
| 4,653,119 | A | | 3/1987 | Kaiser | |
| 4,953,232 | A | | 9/1990 | Gaines et al. | |
| 4,980,927 | A | | 1/1991 | Wawiluk et al. | |
| 5,651,140 | A | * | 7/1997 | Gibson | 2/46 |
| 5,711,030 | A | | 1/1998 | Anderson et al. | |
| 5,940,882 | A | | 8/1999 | Auguste | |
| 5,956,763 | A | * | 9/1999 | Blackshear | 2/49.1 |
| 5,991,919 | A | * | 11/1999 | Baggetto | 2/50 |
| 6,094,744 | A | | 8/2000 | Dibenedetto et al. | |
| 6,385,774 | B1 | * | 5/2002 | Rodgers | 2/50 |

* cited by examiner

*Primary Examiner*—Amy B. Vanatta
(74) *Attorney, Agent, or Firm*—Caesar, Rivise, Bernstein, Cohen & Pokotilow, Ltd.

(57) ABSTRACT

A bi-functional collar guard includes two elongated narrow parts and a wide part disposed between the elongated narrow parts, wherein the bi-functional collar guard removably outfits a neckline of clothing by placing a folded part inside the clothing and thereby aligning an upper part of the bi-functional collar guard substantially parallel to an outer part of the neckline such that a fold line of the bi-functional collar guard coincides with the outer part of the neckline.

4 Claims, 7 Drawing Sheets

COLLAR GUARD

BACKGROUND OF THE INVENTION

1. Field of Invention

This invention relates to disposable collar guards which can protect a wearer from staining or irritating substances or other fluids and particles.

2. Description of Related Art

Hair care professionals and beauticians use different means for protecting clothing of their clients during various procedures such as hair coloring, wash, haircuts and makeup applications. Frequently, various kinds of protective capes or even towels are used to prevent staining or irritating substances or other fluids and particles from contacting with clients' clothing. Still, despite preventive measures, collars of the clothing become stained and therefore, the clothing gets ruined. Thus, even though bulky capes provide the overall coverage, they fail to protect the collars. An example of a protective cape is a cape described in U.S. Pat. No. 6,094,744 to Dibenedetto et al. This patent describes a protective covering in a shape of a cape, wherein a triangular portion of the covering is tucked in between the neck of a person and his collar with the remaining portion extending out to cover the shoulders and back of a person.

Several patents describe replaceable collar protectors that are intended for permanent wear. These protectors mimic the shape of the collar and conceal the outer ends of the collar. U.S. Pat. No. 2,637,034 to Smith describes a collar protector which is made to tightly fit a collar by slipping it on an envelope. U.S. Pat. No. 3,860,967 to Tedesco describes a collar protector having the collar's ends tucked in pockets for receiving the ends to conceal and protect the collar. See also U.S. Pat. No. 4,953,232 to Gaines et al.

Other patents describe collar protectors, which engage only the inside part of the collar and are aimed to protect the inside part of the collar from contacting with the neck of a wearer of the garment. U.S. Pat. No. 4,008,494 to Hicks describes a strip of a flexible fabric to be removably secured to the neck band of a garment. See also U.S. Pat. No. 4,653,119 to Kaiser, U.S. Pat. No. 5,940,882 to Auguste, and U.S. Pat. No. 5,711,030 to Anderson et al.

U.S. Pat. No. 4,651,347 to Brown describes a protective shield for a collar of an outer garment to protect the collar from being stained by hair gel or oil. The protective shield covers only an upper side of the collar and includes (1) an outer layer made of real or simulated leather having a smooth, non-adsorbent surface from which the hair gel or oil can be wiped off and (2) an inner layer, which is made of cloth and is connected to the outer layer and has means for attaching the protective shield to the collar. This protective shield is not intended to protect areas other than the collar.

U.S. Pat. No. 4,980,927 to Wawiluk et al. describes a disposable adherent collar in a shape of an isosceles triangle, wherein the top portion of the triangle contains an adhesive band for securing the disposable adherent collar to the top part of a collar on a shirt of a wearer. There are a number of problems with this disposable adherent collar, such that it depends on the adhesive for retention on the collar, and its shape does not provide any additional means for being retained on the collar. Further, when placed around the collar of the wearer, the triangular shape of the disposable adherent collar would form a bulge, which could be a source of discomfort and thereby limits its applications for other purposes. As such, the disposable adherent collar is not suitable for protecting the front of the wearer's clothing for application of potentially staining substances such as, for example, make-up materials. Finally, manufacturing of the disposable adherent collar includes additional steps for applying the adhesive.

None of the above described protective coverings provide a disposable covering for protection of clothing during hair care or make up applications which is easy and effective to use, economic to make, and is versatile for variety of applications. Therefore, despite above described efforts, there is a need for a disposable bi-functional collar guard, which would have the above qualities.

All references cited herein are incorporated herein by reference in their entireties.

BRIEF SUMMARY OF THE INVENTION

Accordingly, the invention provides a bi-functional collar guard includes two elongated narrow parts and a wide part disposed between the elongated narrow parts, wherein the bi-functional collar guard removably outfits a neckline of clothing by placing a folded part inside the clothing and thereby aligning an upper part of the bi-functional collar guard substantially parallel to an outer part of the neckline such that a fold line of the bi-functional collar guard coincides with the outer part of the neckline. In certain embodiments, the neckline is in a shape of a collar.

In certain embodiments, a ratio of a length of two elongated narrow parts to a length of the wide part is about 1 to 1. In certain embodiments, the fold line is permanently formed on the bi-functional collar guard. In certain embodiments, the two elongated narrow parts have a rectangular shape and the wide part has a semi-round shape. In certain embodiments, the bi-functional collar guard comprises a repellent material. In certain embodiments, the bi-functional collar guard is disposable.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention was driven by a desire to develop an easy and effective to use, economic to make, and versatile for variety of applications disposable covering for protection of clothing during hair care or make-up applications.

The invention is a disposable bi-functional collar guard, which comprises two elongated narrow parts and a wide part disposed between the elongated narrow parts. The unique design of the bi-functional collar guard of the invention allows retention of the guard on the neckline without using adhesives or other means for securing it to clothing. The ratio of the sum of the lengths of both elongated narrow parts to the wide part is approximately 1 to 1, and the width of the narrow part is selected to accommodate average size collars as further specified below. Thus, when the collar guard is placed on the neckline of the wearer, it substantially takes the shape of the part of the clothing immediately adjacent to the neckline without forming a bulge on the back of the wearer.

Figure 1B:
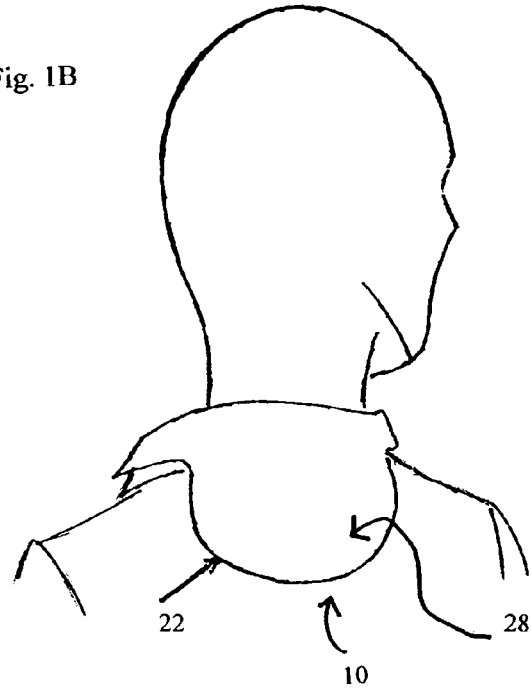
FIG. 1A is a front perspective view and FIG. 1B is a back perspective view of a person demonstrating wearing a bi-functional collar guard of the invention placed over the shirt collar. In this embodiment, the wide part of the collar guard is placed in the back of the person.
Figure 1A:
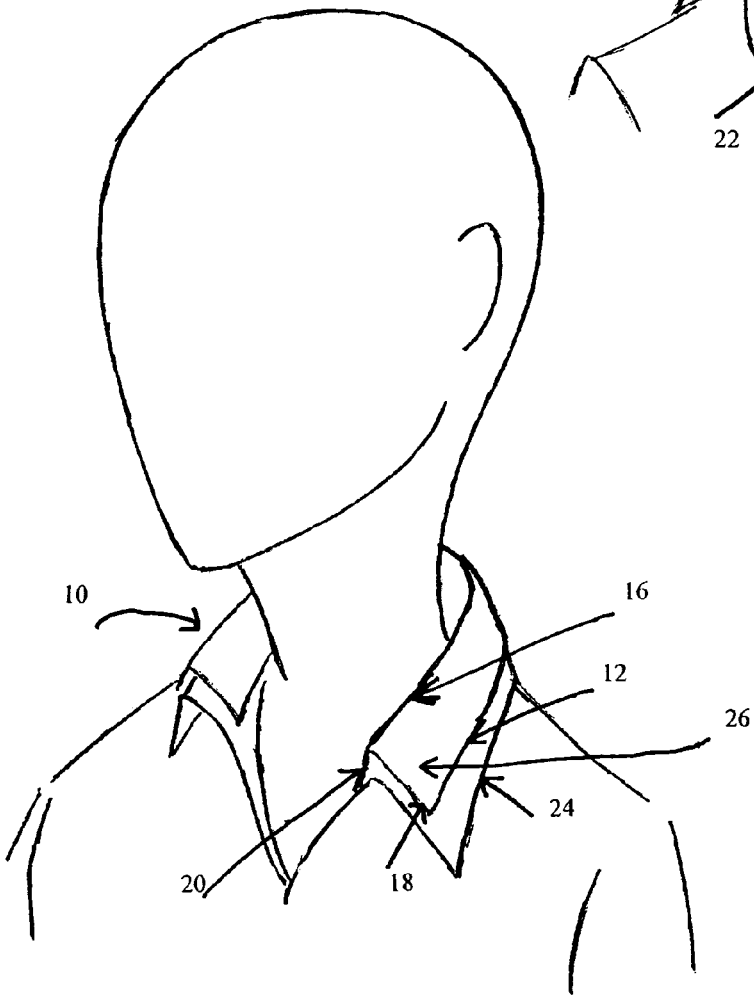

The bi-functional collar guard is designed to protect a neckline of a shirt, a dress, a sweater or another type of clothing of a wearer during hair care related applications from being stained, soiled or wet, by placing the collar guard over the neckline such as, for example, a collar, and tucking a folded part of the guard inside the neckline. This describes a collar guard function of the invention (see FIGS. 1A and 1B). In this variant, the wide part of the collar guard is placed on the back of the wearer.

Figure 2B:
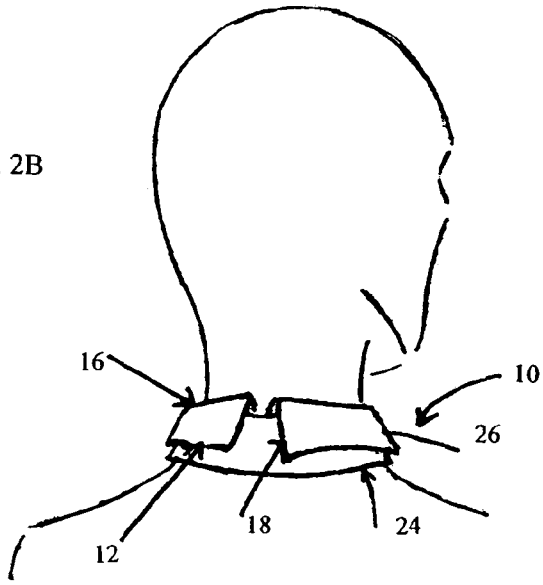
FIG. 2A is a front perspective view and FIG. 2B is a back perspective view of a person demonstrating an alternative mode of wearing the bi-functional collar guard of the invention, wherein the wide part of the collar guard is placed in the front of the person for protection of the upper chest area during make-up applications.
Figure 2A:
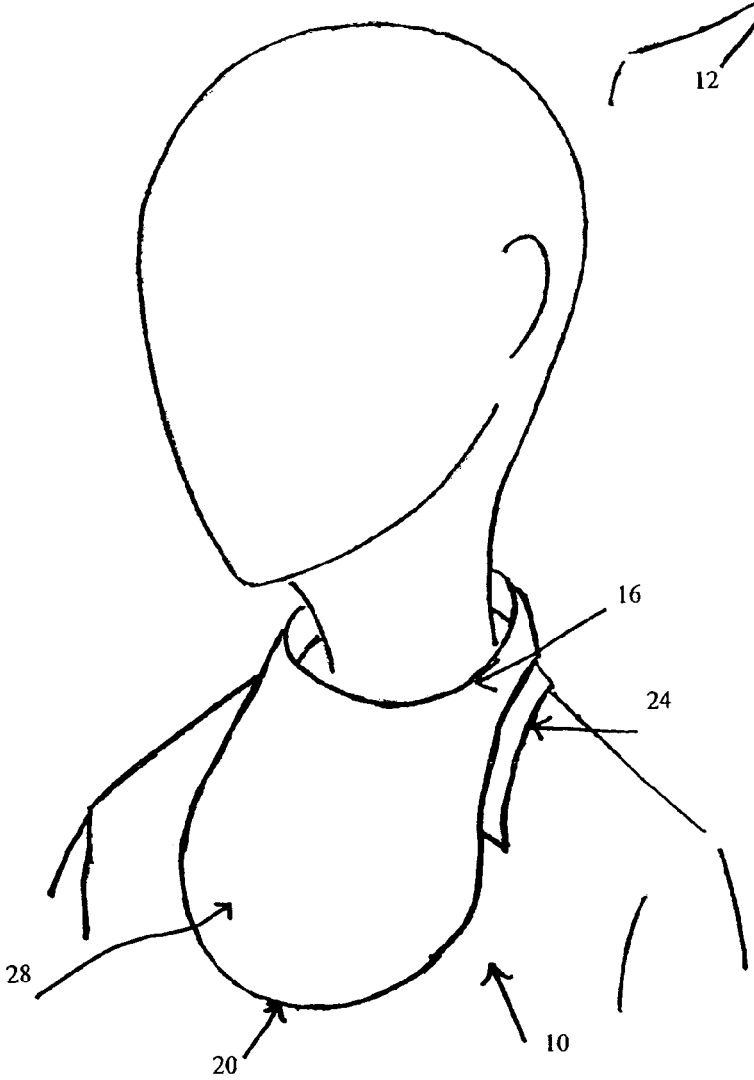

Another function of the collar guard of the invention is to protect the front part of the clothing at the chest area during make-up related applications from being stained or wet by a powder, lipstick, tonic or other solid or liquid substances applied to the face or the neck of the wearer. This describes a collar-and-chest guard function of the invention (see FIGS. 2A and 2B). In this variant, the wide part of the collar guard is placed on the upper chest area of the wearer.

Figure 3A:
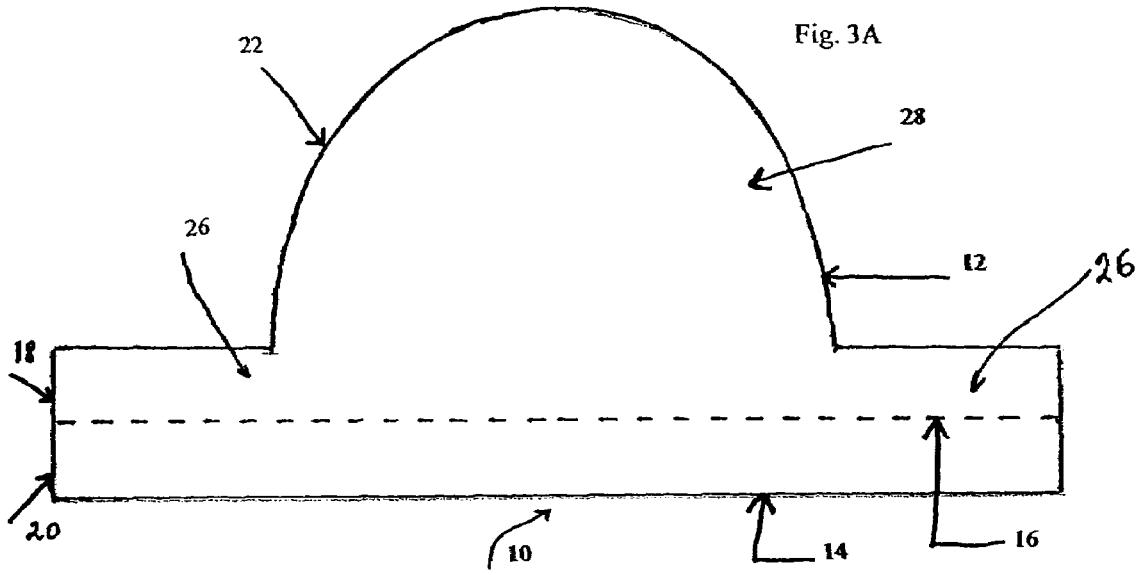
FIG. 3A is a top plan view of the bi-functional collar guard having a fold line depicted therein in accordance with the present invention.
Figure 3B:
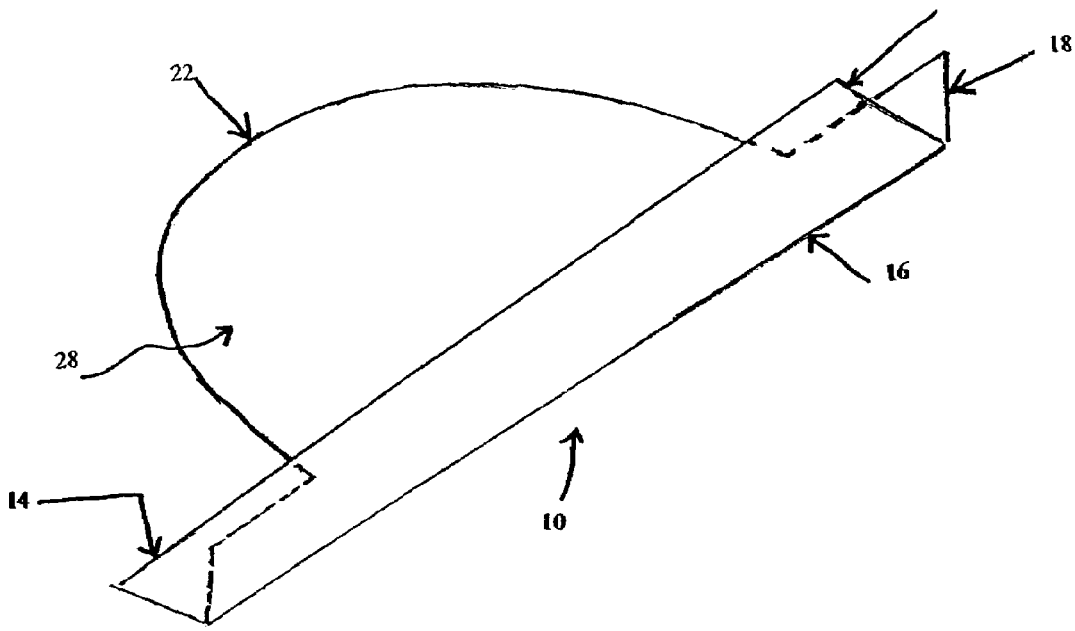
FIG. 3B is an isomeric view of the bi-functional collar guard folded along the fold line for placement on a collar of a wearer in accordance with the present invention.
Figure 4A:
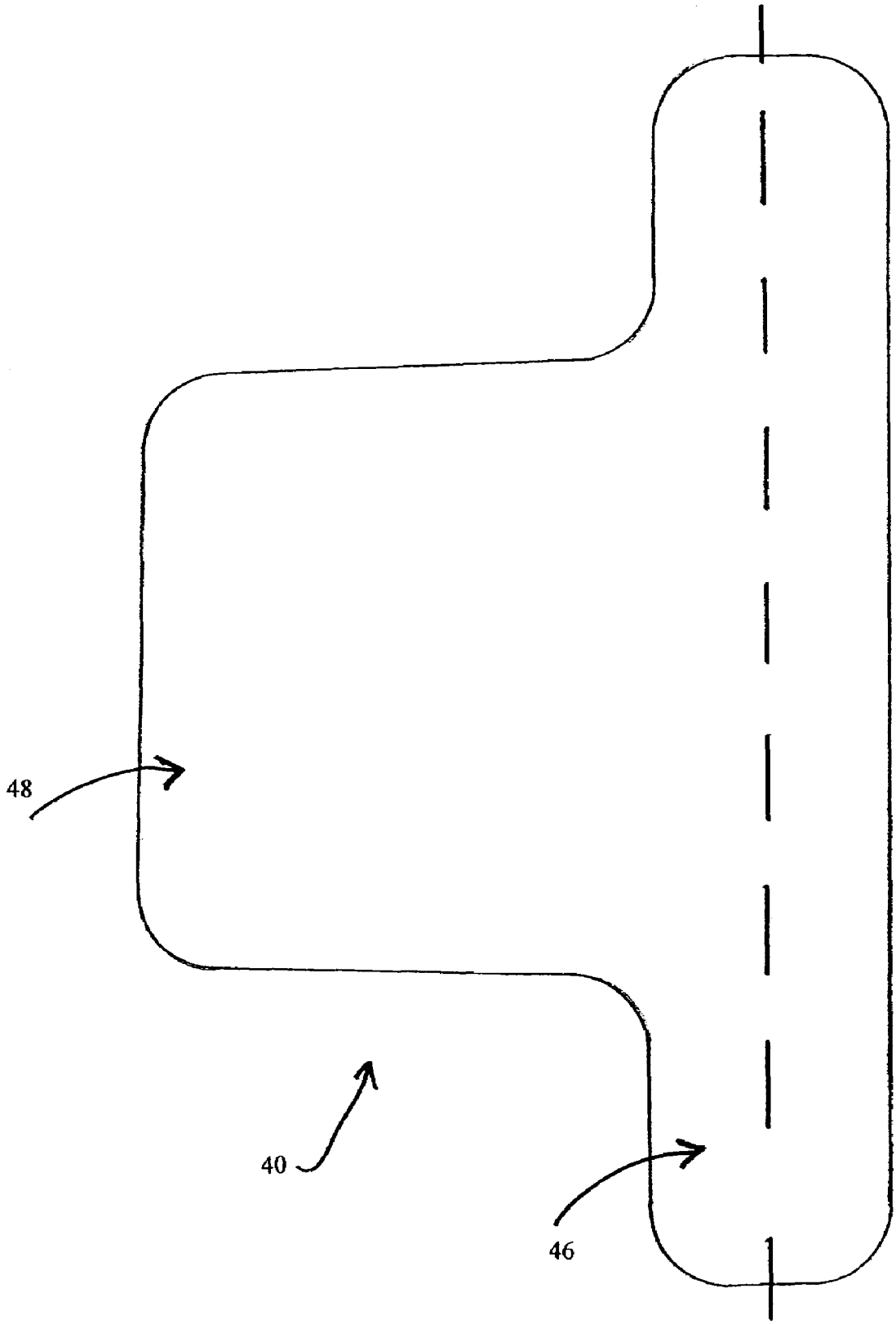
FIGS. 4A–4D are top plan views of various bi-functional collar guards having a fold line depicted therein in accordance with the present invention, shown herein as non-limiting examples demonstrating variations in the shape of the wide part and the narrow part of the collar guard.
Figure 4B:
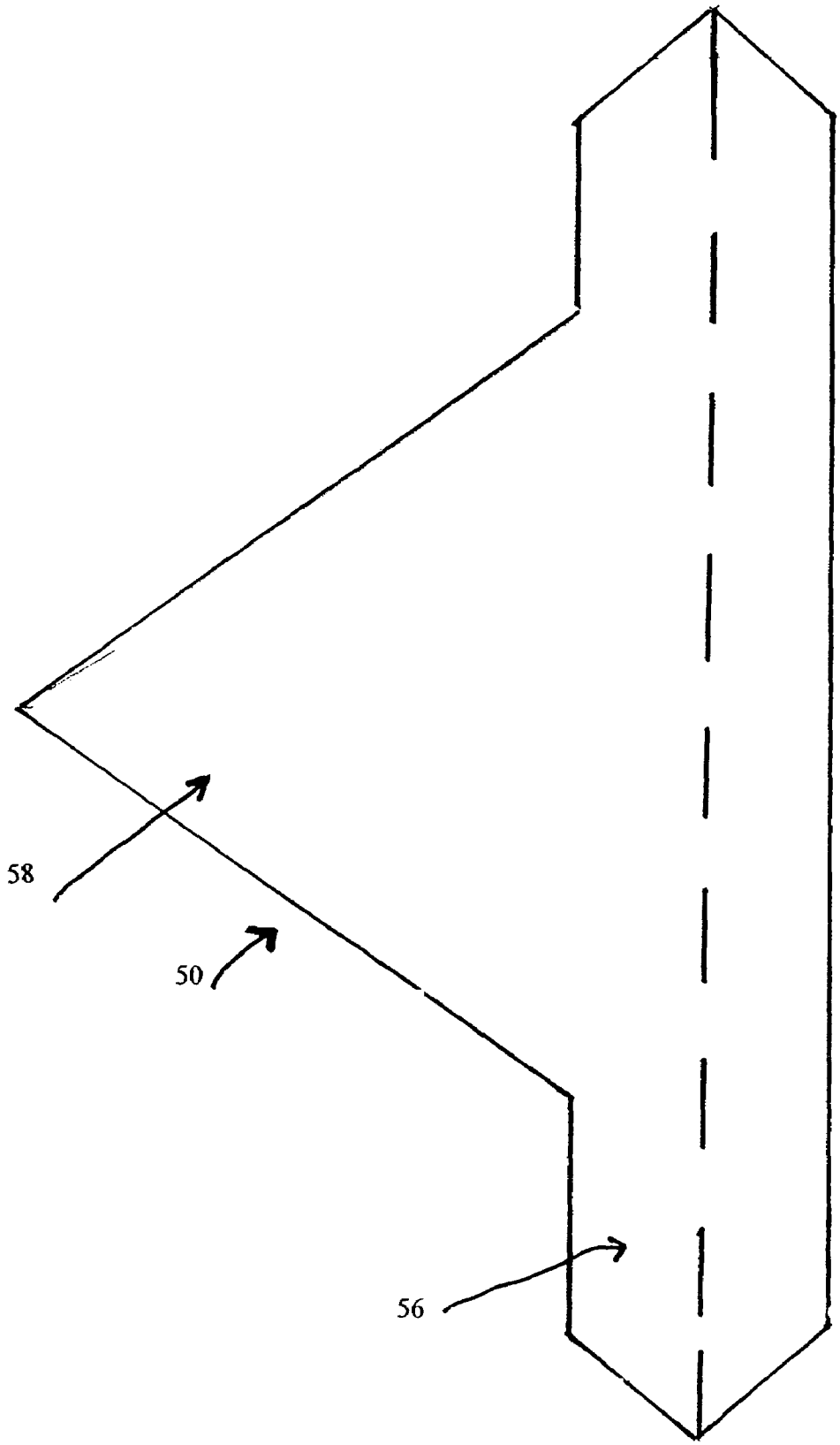
Figure 4C:
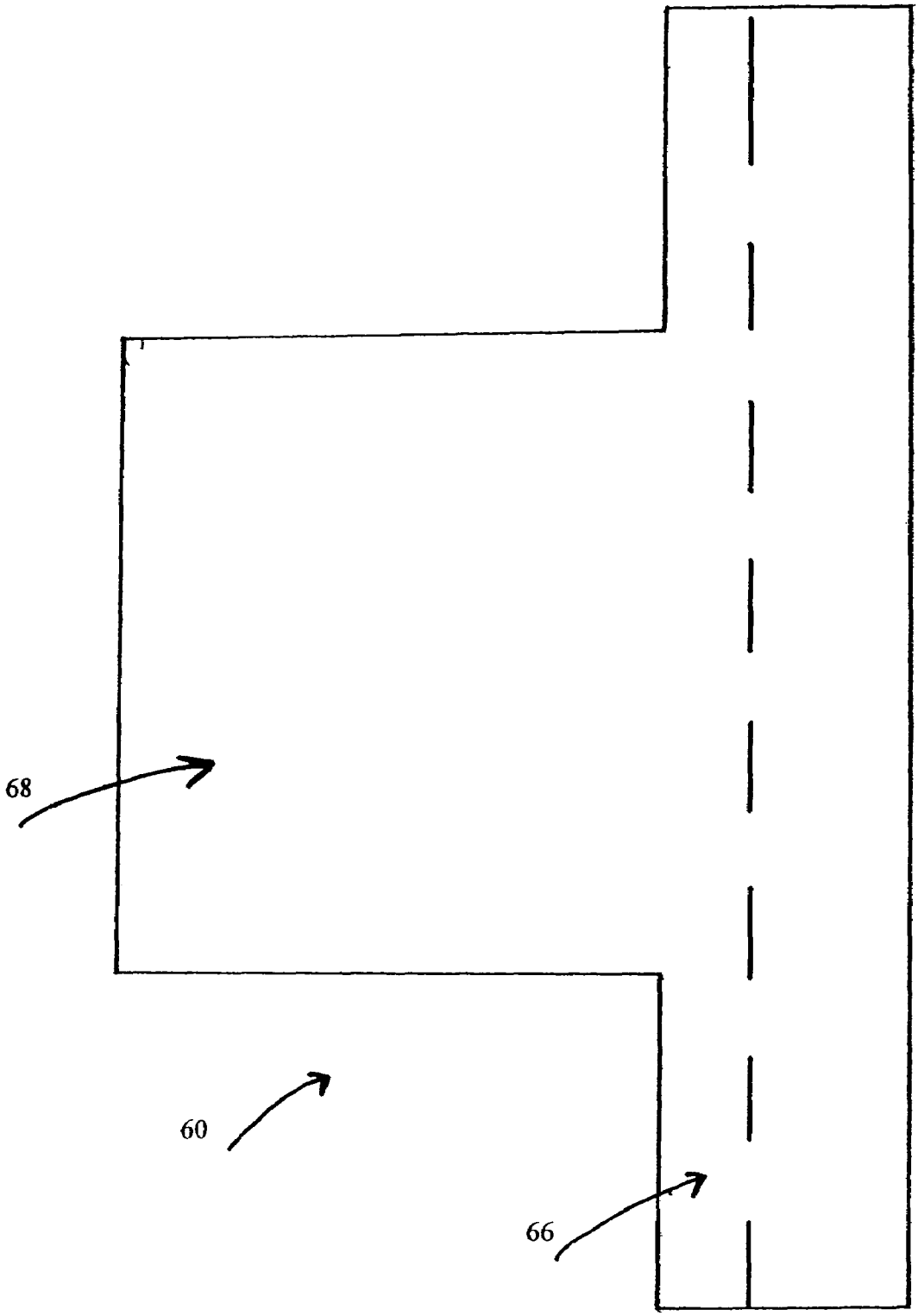
Figure 4D:
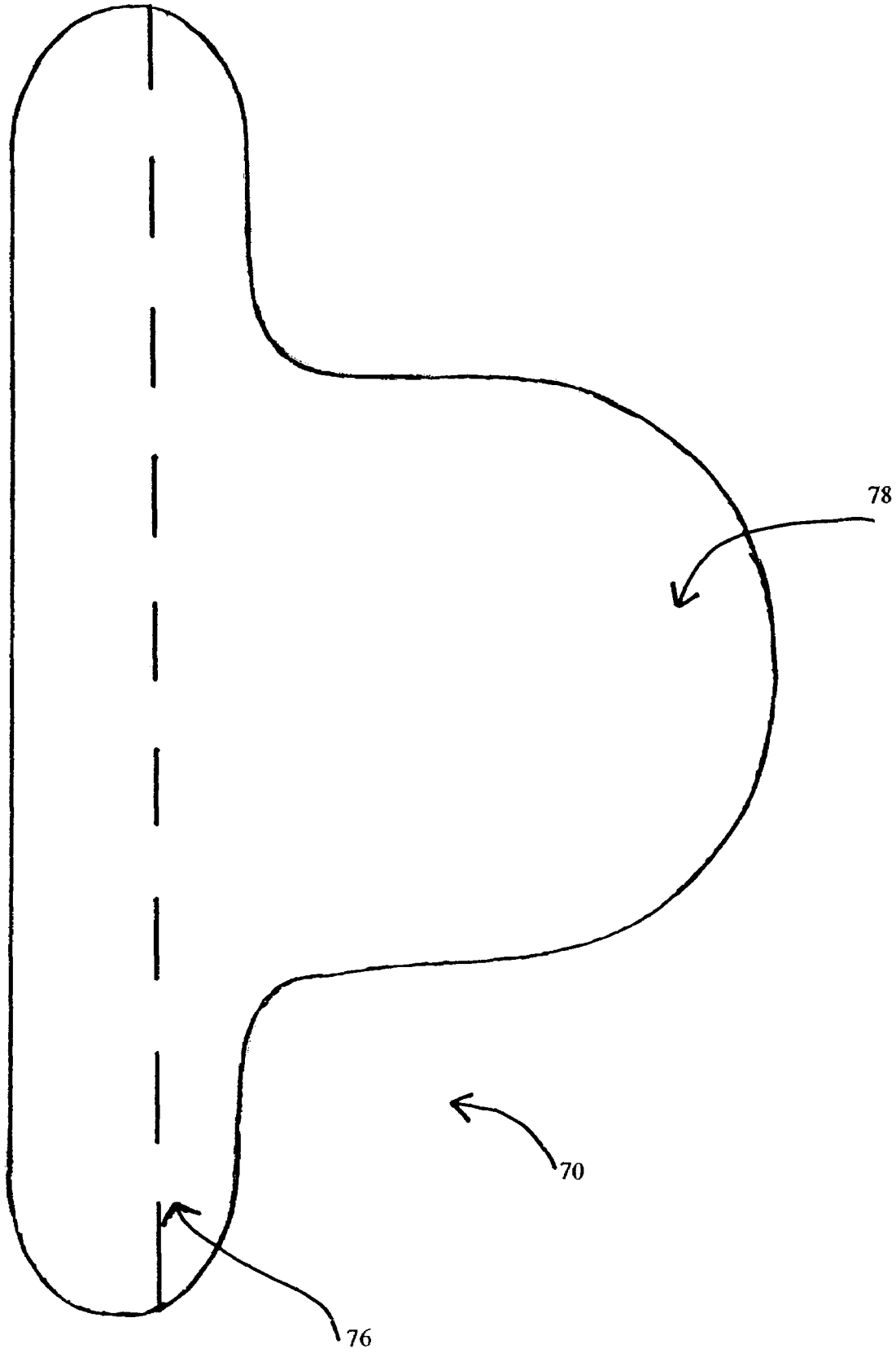

Dimensions and shapes of the collar guard of the invention will now be described in detail with reference to the embodiment depicted in FIGS. 3A and 3B. The collar guard 10 comprises two elongated narrow parts 26 which are outlined by outer surfaces 12, 18, 20 and a wide part 28 disposed between the elongated narrow parts 26. The collar guard 10 is outlined by an upper part 12, which is aligned to be substantially parallel to the outer part of the neckline such that a fold line of the bi-functional collar guard coincides with the outer part of the neckline and is tucked inside the clothing (see Fog. 3B). The elongated narrow parts and the wide part are either folded over the front or the back parts of the neckline depending on the particular function of using the guard (i.e., the collar guard function or the collar-and-chest guard function).

Each of the two elongated narrow parts 26 can be of equal length, however, one elongated narrow part can be shorter than another, provided that the overall length of the collar guard is the same or longer than the length of the collar it is designed to protect. The average length of the elongated narrow part 26 is from about 4 to about 6 inches. The average width of the elongated narrow part 26 is from about 3 to about 4 inches. The elongated narrow part 26 can have a rectangular shape as shown in FIGS. 3A and 3B; however, the corners can be slanted or rounded as shown in FIGS. 4A–4D for elongated narrow parts 46, 56, 66 and 76 accordingly.

The average length of the wide part 28 is from about 8 to about 12 inches. The average width of the wide part 28 is from about 3.5 to about 7 inches. The wide part 28 has a semi-round shape; however other shapes can be employed as shown, for example in FIGS. 4A–4D for wide parts 48, 58, 68, and 78 accordingly.

However, it is understood that the above values are exemplary and can be modified to accommodate differently sized and shaped necklines. Further, the collar guard of the invention can be made in standardized sixes such as, for example, extra small or children sizes as well as small, medium, large and extra large sizes and packaged in boxes similar to boxed tissues or gloves for an easy and efficient distribution for professional or personal use.

When the bi-functional collar guard is placed on the neckline of the wearer, a portion of it (i.e., a folded part) is bent or folded along the fold line 16 and tucked inside the clothing. The bi-functional collar guard 10 preferably has a fold line 16 that is built-in during manufacturing process by, for example, folding and pressing the elongated narrow part 26 of the collar guard 10 approximately in half by bringing together the top part 20 and the bottom part 18 of the elongated narrow part 26. Alternatively, the fold line 16 can be formed after the manufacturing by storing the collar guard 10 folded along the fold line 16. In certain embodiments, the fold line 16 is not pre-made during the manufacturing process or storage and is formed during the application of the collar guard by placing the collar guard over the neckline and tucking the bottom part 18 inside the clothing and placing the top part 20 over the neckline and on the outer part of the clothing immediately below the neckline.

The disposable bi-functional collar guard can be made from thin flexible non-woven materials which preferably repel liquids or are treated to repel liquids such as, for example, polymeric materials, e.g., polyethylene, polypropylene, polyurethane, and polyester. It can also be made from woven materials which are treated to repel liquids such, for example, cotton. It can also be made from paper or recycled material as long as the resulting guard repels liquids and acts as an impermeable shield. In certain embodiments wherein no chemicals or other liquids are used but protection of the collar from being soiled with hair is desired, such as, for example, during a hair cut, the repellant quality of the guard of the invention is not critical and can be omitted. In some embodiments, care should be taken to avoid the use of substances causing allergies, such as, for example, latex materials.

The disposable bi-functional collar guard can be manufactured by processes known in the art such as, for example, injection molding, extrusion, stamping, cutting and the like. The bi-functional collar guard can be made from a single sheet of suitable material or fused from several parts. As described above, the fold line can be made simultaneously with forming the outer shape of the guard or the fold line can be made after the guard is obtained by, for example, bending and applying a pressure to the folded part, similar to the ironing process or simply by storing the guard in a folded manner prior to use.

The utility of the collar guard is not limited to hair or face related applications. It can be used in any settings wherein the protection of the neckline of an item of clothing is desired. For example, the collar guard of the invention can be used in medical settings such as, for example, in a dermatologist or a dentist office or in nursing homes.

While the invention has been described in detail and with reference to specific examples thereof, it will be apparent to one skilled in the art that various changes and modifications can be made therein without departing from the spirit and scope thereof.

What is claimed is:

1. A bi-functional collar guard comprising two elongated narrow parts and a wide part disposed between the two elongated narrow parts, wherein a ratio of a length of two elongated narrow parts to a length of the wide part is about 1 to 1, wherein the fold line is permanently formed on the bi-functional collar guard and is formed by folding the elongated narrow parts of the collar guard approximately in half by bringing together a top part and a bottom part of each of the elongated parts, wherein the bi-functional collar guard removably outlines a neckline of clothing by placing a folded part inside the clothing and thereby aligning an upper part of the bi-functional collar guard substantially parallel to an outer part of the neckline such that a fold line of the bi-functional collar guard coincides with the outer part of the neckline, wherein the bi-functional collar guard comprises a repellant material.

2. The bi-functional collar guard of claim 1, wherein the two elongated narrow parts have a rectangular shape and the wide part has a semi-round shape.

3. The bi-functional collar guard of claim 1, wherein the bi-functional collar guard is disposable.

4. The bi-functional collar guard of claim 1, wherein the neckline is in the shape of a collar.

* * * * *